US008367567B2

(12) United States Patent
Chandra et al.

(10) Patent No.: US 8,367,567 B2
(45) **Date of Patent: *Feb. 5, 2013**

(54) SHELF LIFE EXTENDING CONTAINER FOR FRUITS AND VEGETABLES

(76) Inventors: Shubham Chandra, Milford, MA (US); Benjamin Scott Williams, Norwood, MA (US)

( * ) Notice: Subject to any disclaimer, the term of this patent is extended or adjusted under 35 U.S.C. 154(b) by 297 days.

This patent is subject to a terminal disclaimer.

(21) Appl. No.: 12/852,590

(22) Filed: Aug. 9, 2010

(65) Prior Publication Data

US 2011/0048252 A1 Mar. 3, 2011

Related U.S. Application Data

(63) Continuation-in-part of application No. 12/051,844, filed on Mar. 19, 2008, now Pat. No. 7,772,139.

(51) Int. Cl.

| | |
|---|---|
| ***B32B 5/18*** | (2006.01) |
| ***B32B 5/22*** | (2006.01) |
| ***B01D 46/46*** | (2006.01) |
| ***B01D 53/22*** | (2006.01) |
| ***B01D 59/12*** | (2006.01) |
| ***A47J 27/04*** | (2006.01) |

(52) U.S. Cl. ..... 442/76; 95/12; 95/51; 95/54; 96/11; 96/12; 99/473

(58) Field of Classification Search ..... 95/12, 51, 95/54; 96/11, 12; 99/473; 442/76
See application file for complete search history.

(56) References Cited

U.S. PATENT DOCUMENTS

| | | | | |
|---|---|---|---|---|
| 2004/0195115 | A1* | 10/2004 | Colombo | 206/204 |
| 2007/0059406 | A1* | 3/2007 | Shahsavarani | 426/106 |

* cited by examiner

*Primary Examiner* — Elizabeth Cole
*Assistant Examiner* — Jeremy R Pierce

(57) ABSTRACT

The Shelf Life Extending Container for fruits and vegetables extends the shelf life of various fresh fruits and vegetables and vase life of fresh cut flowers by changing the atmosphere in which these living products are stored and respires. The Shelf Life Extending Container does this by utilizing a Gas Permeable Non-Woven Fabric Based Film. The high oxygen and carbon dioxide permeability of the Gas Permeable Non-Woven Fabric Based Film establishes an ideal atmosphere for the multiple perishable items stored within the Shelf life Extending Container, and therefore extends their shelf life. The establishment of lower oxygen and carbon dioxide atmospheres within the Shelf Life Extending Container using the Gas Permeable Non-Woven Fabric Based Film, also leads to a reduction in the respiration rate of the perishable items stored. The reduction in the respiration rate of the perishable items prevents loss of moisture, production of metabolic heat, yellowing, browning, and reduces the production levels of ethylene by the perishable items. Therefore, the created atmosphere is able to extend shelf life, maintain high quality, and preserve nutrients of fresh produce items by naturally regulating respiration of said produce/flowers.

5 Claims, 12 Drawing Sheets

KEY COMPONENTS OF THE SHELF LIFE EXTENDING CONTAINER WITHOUT THE GAS PERMEABLE NON-WOVEN FABRIC FILM

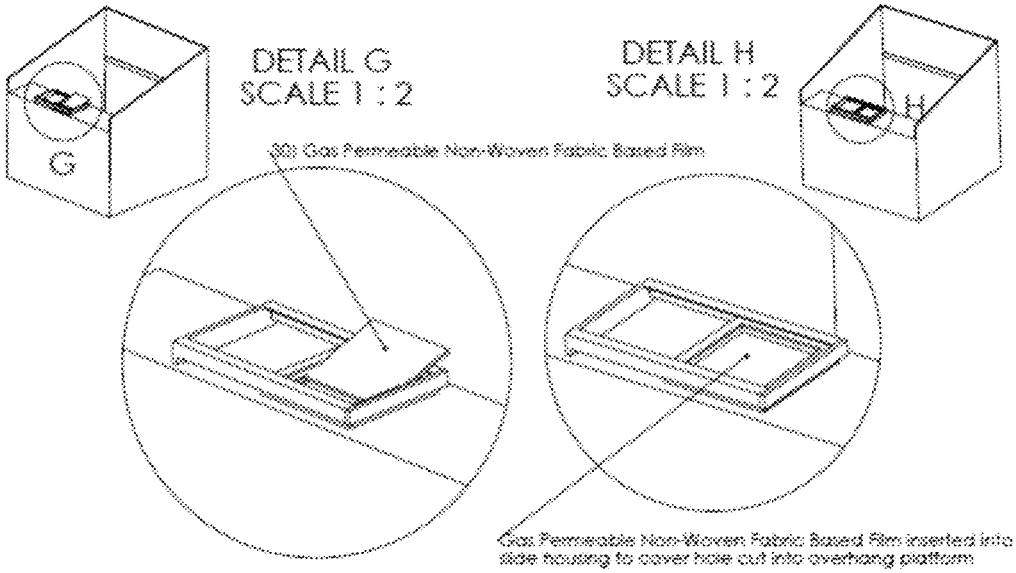
FIGURE 1: SHELF LIFE EXTENDING CONTAINER WITH GAS PERMEABLE NON-WOVEN FABRIC FILM

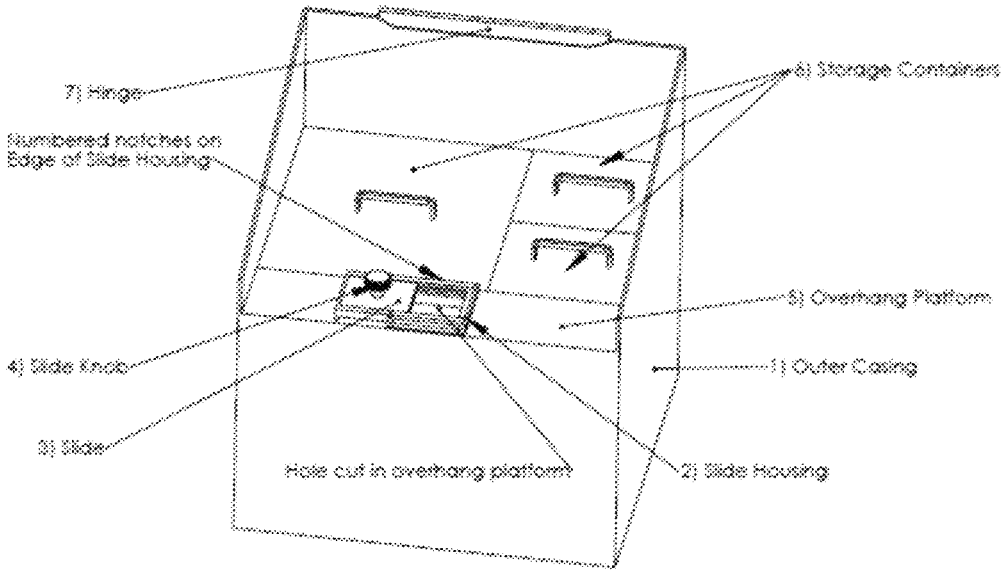
FIGURE 2: KEY COMPONENTS OF THE SHELF LIFE EXTENDING CONTAINER WITHOUT THE GAS PERMEABLE NON-WOVEN FABRIC FILM

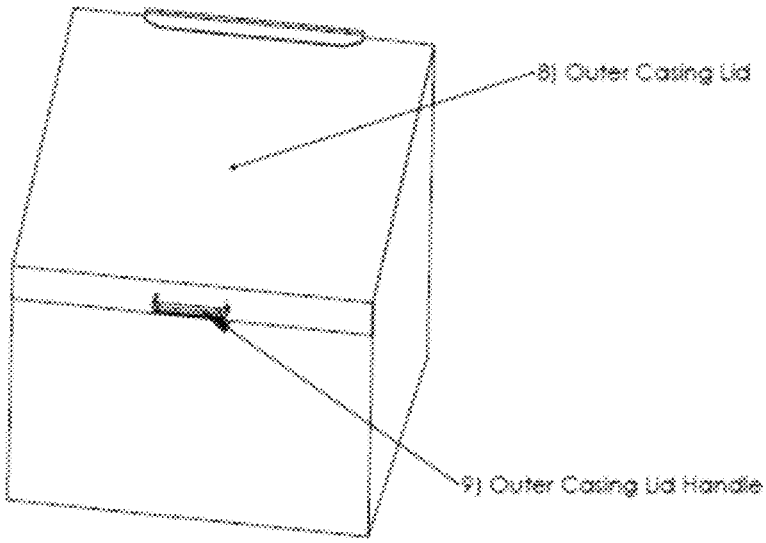
FIGURE 3: EXTERIOR OF THE SHELF LIFE EXTENDING CONTAINER

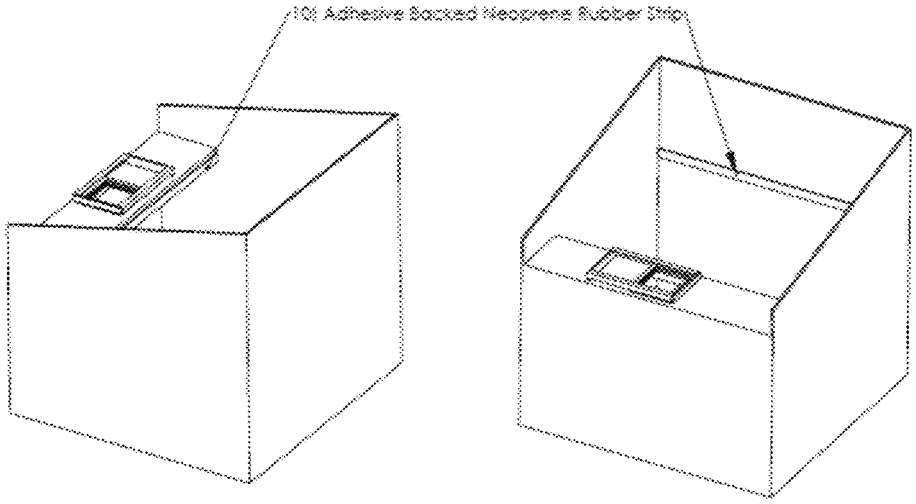
FIGURE 4: LOCATION OF THE ADHSEIVE BACKED NEOPRENE RUBBER STRIP IN THE SHELF LIFE EXTENDING CONTAINER

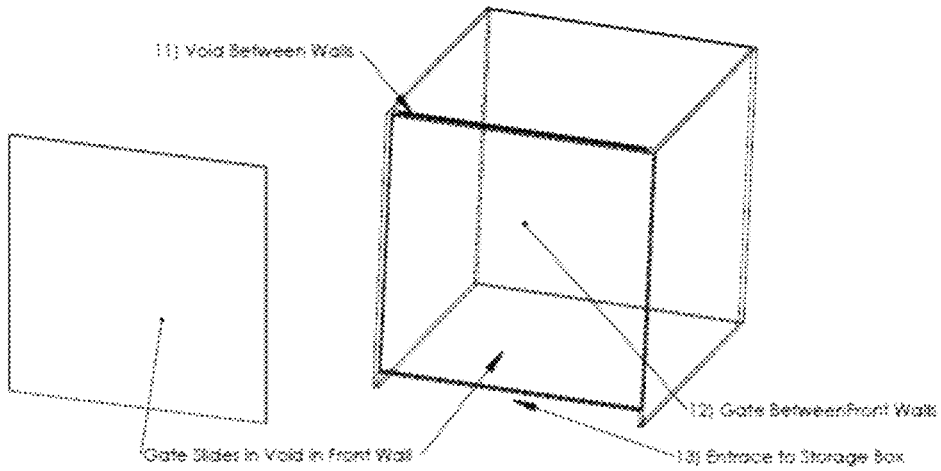
FIGURE 5: Large Storage Box

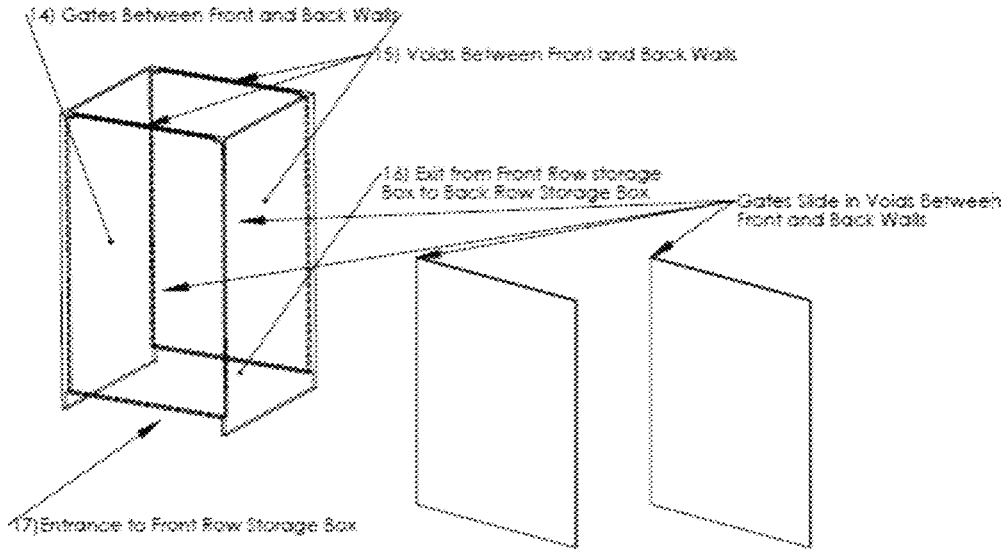
FIGURE 6: FRONT Small Storage Box

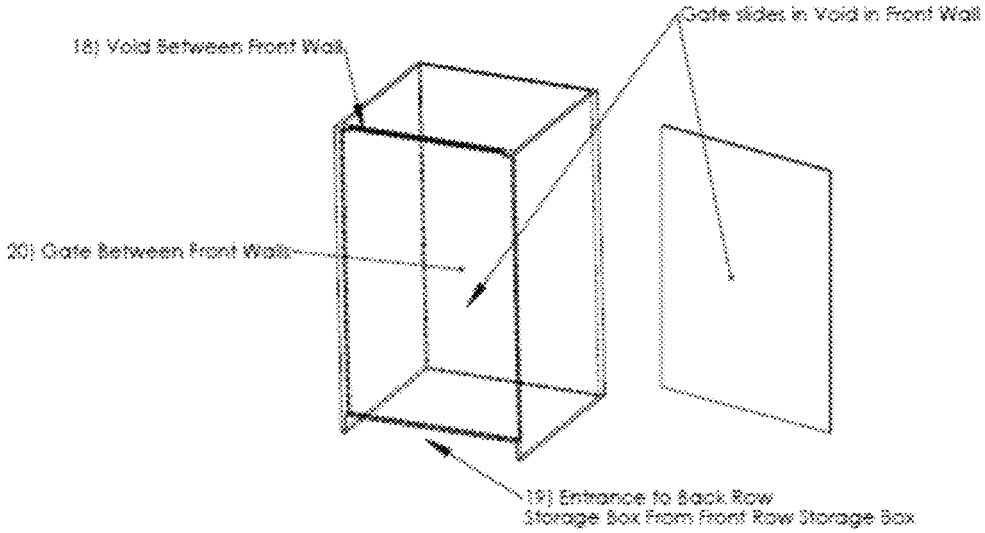
FIGURE 7: Rear Small Storage Box

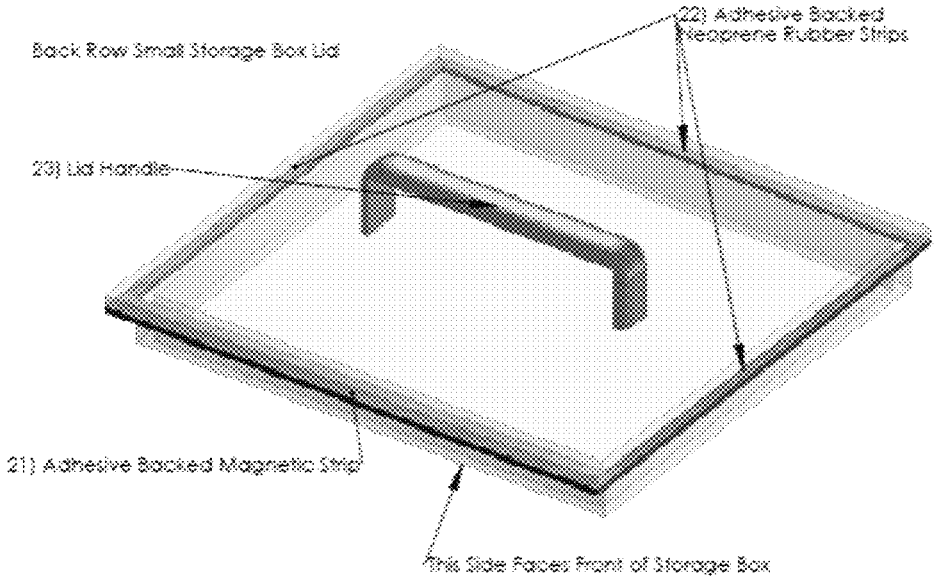
FIGURE 8: BACK ROW SMALL STORAGE BOX LID

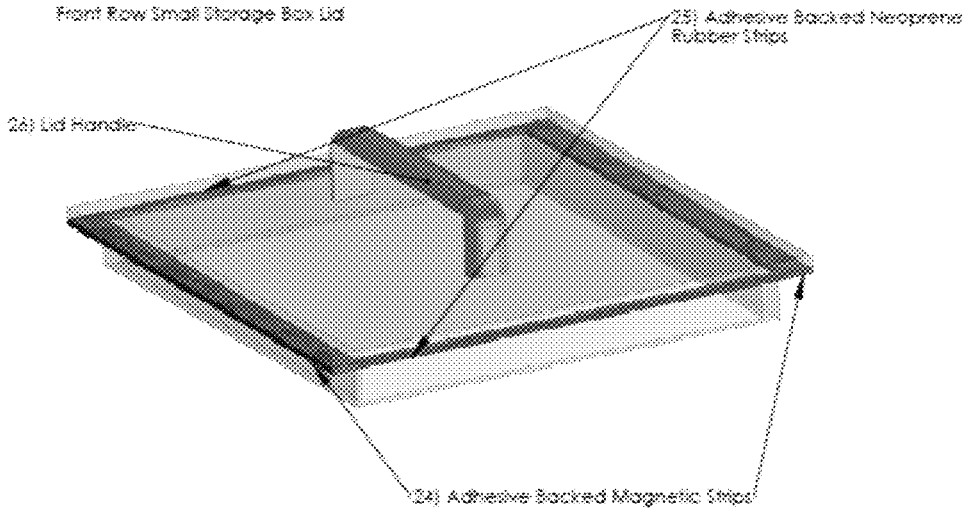
FIGURE 9: FRONT ROW SMALL STORAGE BOX LID

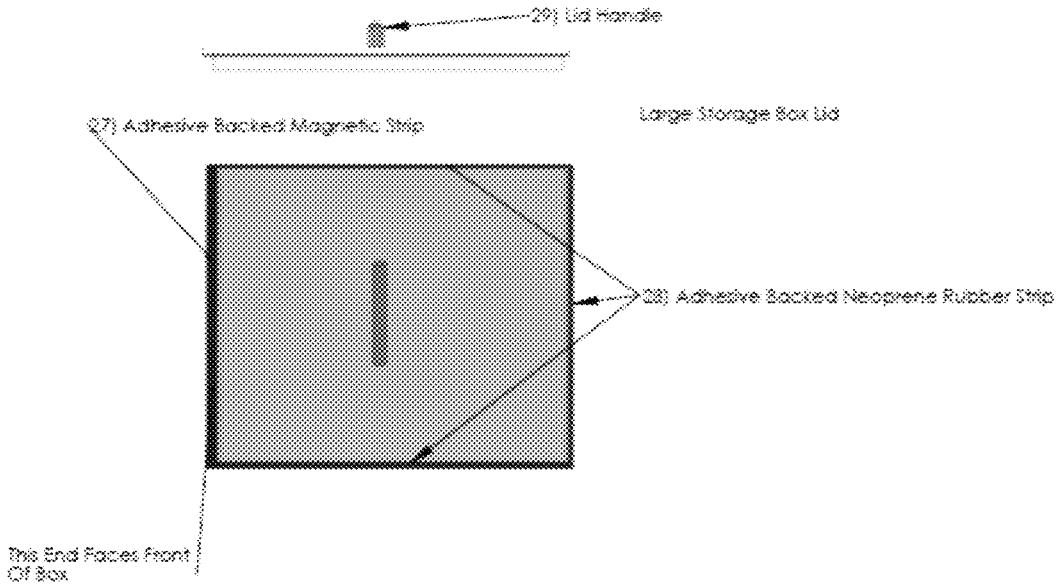
FIGURE 10: Large Storage Box Lid

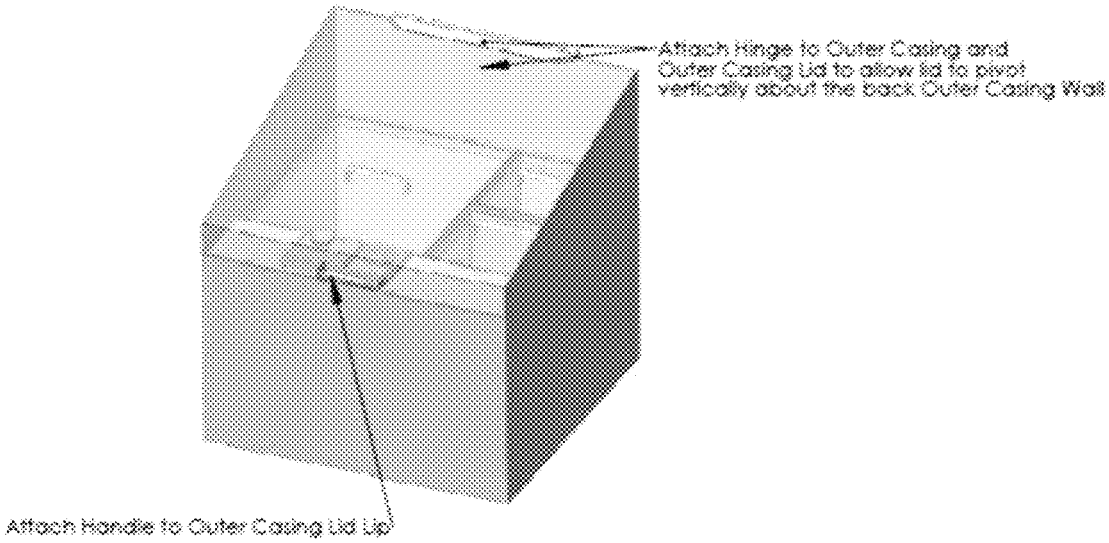
FIGURE 11: LOCATION OF THE HANDLE AND HINGE ON THE CONTAINER

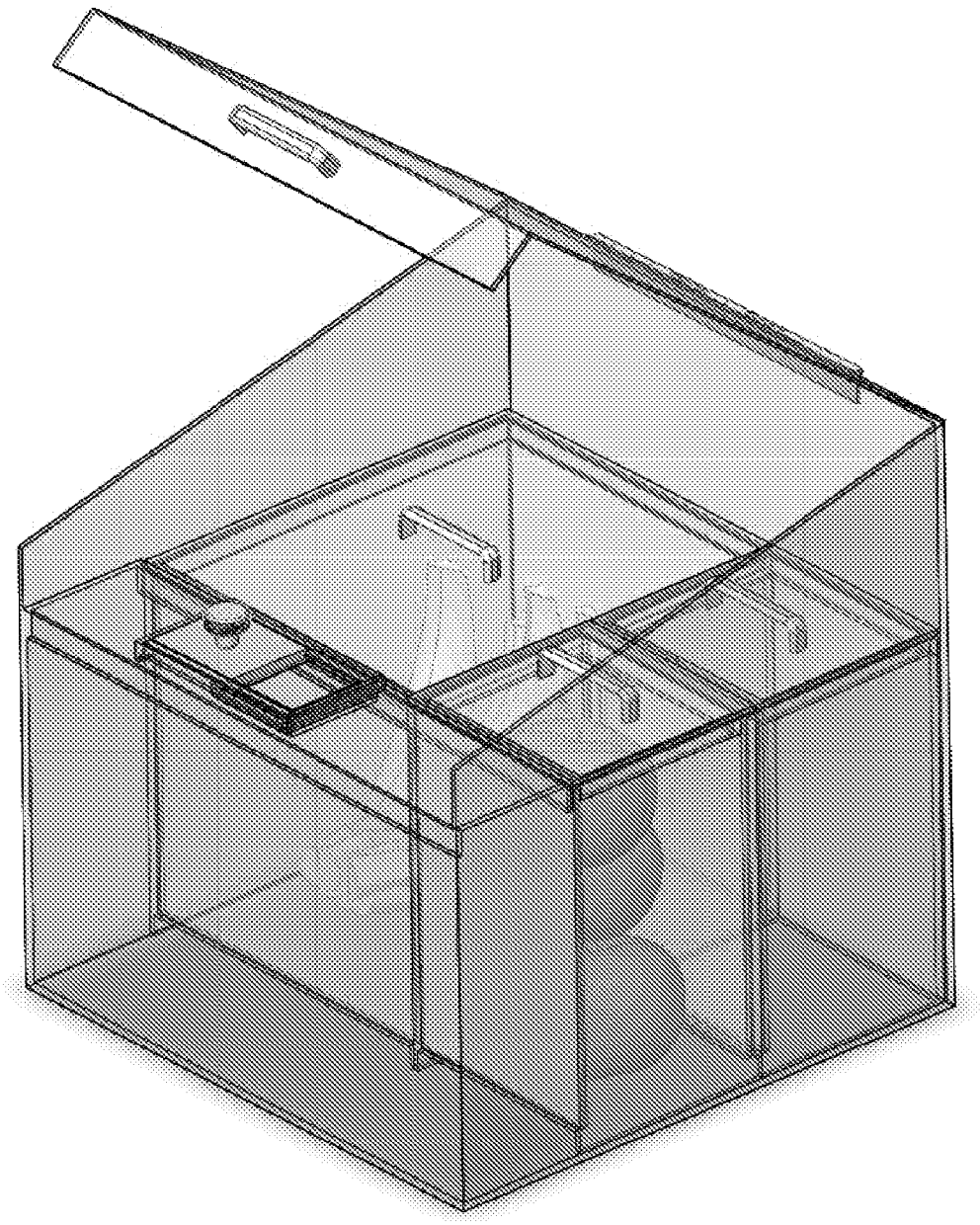
FIGURE 12: THE SHELF LIFE EXTENDING CONTAINER WITH PRODUCE.

SHELF LIFE EXTENDING CONTAINER FOR FRUITS AND VEGETABLES

RELATED APPLICATIONS

This invention is a continuation in part (CIP) to U.S. patent application Ser. No. 12/051,844, filed on Mar. 19 2008, which is now issued as U.S. Pat. No. 7,772,139,the contents of which are herby incorporated by reference. The examiner for this application was TORRES VELAZQUEZ, NORCA LIZ. This applications claims priority to the application, Ser. No. 12/051,844.

FIELD OF THE INVENTION

The invention relates to a container with a gas Permeable Non-Woven Fabric based Film with high permeability towards oxygen and carbon dioxide, and is directed more particularly to such a container as is suitable for extending the shelf life of multiple types of fresh fruits and vegetables (both whole and fresh cut).

BACKGROUND

Produce is a living tissue that derives energy primarily by exchanging gases with its surroundings through the process of respiration. Respiration involves the consumption of atmospheric oxygen, carbohydrates, and organic acids by the plant tissue, and the consequent production and release of metabolic energy, heat, carbon dioxide and water vapor.

The packaging systems provided in the art range from basic low density polyethylene bags to fairly sophisticated high oxygen transmission rate gas permeable membranes.

SUMMARY

Some shortcomings of such packaging systems include the inability to establish ideal oxygen and carbon dioxide atmosphere levels inside the packaging simultaneously. Typically, since the permeation rate for such packages for oxygen and carbon dioxide is the same, if the oxygen atmosphere inside the package is 5%, the carbon dioxide atmosphere will be 21−5=16%. So in essence the sum of oxygen and carbon dioxide levels will be 21%. Therefore, atmospheres such as 2% Oxygen and 5% Carbon Dioxide cannot be achieved.

Further, many of the packaging systems in use control and/or inhibit the growth of ethylene levels inside the package containing produce. Ethylene is a ripening agent, which is produced naturally in fresh fruits and vegetables as they respire. However, controlling the ethylene levels does not guarantee shelf life or, in the case of flowers, vase life extension, because the oxygen levels and carbon dioxide levels need to be controlled simultaneously. Reduced oxygen levels caused increased metabolic activity and hence reduction in shelf life, and increased carbon dioxide levels leads to tissue softening, and fungal and bacterial growth.

Still further, use of polyethylene bags do not have the adequate permeability needed for long term storage of produce and/or flowers. Issues such as development of anaerobic conditions when the oxygen levels go below 1% and development of high carbon dioxide levels permanently injure the produce; make the use of low density plastic bags incapable in shelf life extensions.

Accordingly, there remains room for improvement in many areas of shelf life and vase life extension technologies.

An objective of the invention is, therefore, to provide a packaging system with a high permeable polymer coated non-woven fabric, which in essence by naturally establishing modified atmospheres inside a package containing fresh produce/flower can effectively extends its shelf/vase life.

Produce is a living tissue that derives energy primarily by exchanging gases with its surroundings through the process of respiration. Respiration involves the consumption of atmospheric oxygen, carbohydrates, and organic acids by the plant tissue, and the consequent production and release of metabolic energy, heat, carbon dioxide and water vapor. As the produce consumes oxygen and gives off carbon dioxide, an equilibrium gas concentration is established in the package. The gas permeable non-woven film (gas permeable film) is capable of providing different package permeabilities in order to maintain specific oxygen and carbon dioxide levels in a package and maintain this optimum atmosphere even as the temperature is changing. As the produce or other agricultural item consumes oxygen and give off carbon dioxide, the equilibrium gas concentration is established in the package. This process is a function of the permeability of the polymer and its selectivity ration of oxygen to carbon dioxide. Thus, the created atmosphere is adapted to extend shelf life, maintain high quality and preserve nutrients of fresh produce items by naturally regulating respiration of the agricultural items.

Thus the created atmosphere is able to extend shelf life, maintain high quality and preserve nutrients of fresh produce items by regulating the respiration of the targeted items. Gas Permeable Non-Woven Fabric based Film, which allows for Carbon Dioxide gas to move in and out of the packaging at a rate many times greater than that of Oxygen. By reducing the atmospheric levels of Oxygen and increasing the atmospheric levels of Carbon Dioxide within the packaging, the ripening of fresh produce and fresh cut flowers can be delayed, the produce's respiration and ethylene production rates can be reduced, the softening of the produce can be retarded, and various compositional changes associated with produce ripening can be slowed down.

A particular configuration of the highly permeable non woven fabric based film is obtained by coating nonwoven fabric such as one with 50% polyester and 50% rayon, with a thin layer of polymer, the fabric based system gets its structural strength from the fabric and the permeability from the polymer. This approach enables to reduction in the thickness of the polymer coating on the fabric, and yet maintains enough strength with the fabric, and therefore enhancing its Oxygen Permeation Rate to 110,000 cc/100 in2/day/atm, or even up to 611,111 cc/100 in2/day/atm, with carbon dioxide permeability of at least 350,000 cc/100 in2/day/atm, with a maximum permeability of 3,888,889 cc/100 in2/day/atm at 13° C.

With the above and other objects in view, as will hereinafter appear, a feature of the present invention is the provision of a packaging system including a polyethylene bag, with a hole cutout at the center of the bag, thereof adapted to receive a permeable film, including an adhesive patch for binding the film to the cutout part of the plastic bag, an elastic band for closing the mouth of the plastic bag.

BRIEF DESCRIPTION OF THE DRAWINGS

The foregoing and other objects, features and advantages of the invention will be apparent from the following description of particular embodiments of the invention, as illustrated in the accompanying drawings in which like reference characters refer to the same parts throughout the different views. The drawings are not necessarily to scale, emphasis instead being placed upon illustrating the principles of the invention;

FIG. 1 is a simplified illustration of one form of shelf life extending container with the Gas Permeable Non-Woven Fabric based Film illustrative of an embodiment of the invention.

FIG. 2 is a simplified illustration of the key components of the shelf life extending container without the gas permeable non-woven fabric film;

FIG. 3 is exterior of the shelf life extending container showing the outer case lid handle and the outer case lid;

FIG. 4 is showing the location of the adhesive backed neoprene rubber strip on the container FIG. 5 is showing the large storage box which is contained within the shelf life extending container FIG. 6 is showing the small front storage box;

FIG. 7 is showing the small rear storage box;

FIG. 8 is showing the back row small storage box lid;

FIG. 9 is showing the front row small storage box lid;

FIG. 10 is showing the large storage box lid

FIG. 11 is showing the location of the hinge and handle on the container

FIG. 12 is a picture of the shelf life extending container with produce and transparent walls

DETAILED DESCRIPTION

The Shelf Life Extending Container consists of an outer casing (1), slide housing (2), slide (3), slide knob (4), overhand platform (5), storage containers (6), a hinge (7), an outer casing lid (9) with a handle (9).

The Shelf Life Extending Container's purpose is to preserve the shelf life of fresh fruits and vegetables (FF&V). It does this by controlling the atmosphere within the storage containers via a Gas Permeable Non-Woven Fabric based Film (30). This Gas Permeable Non-Woven Fabric based Film is inserted into the slide housing, allowing it to cover the hole cut into the overhang platform (5). The patch is then glued around its perimeter to seal it into place, as well as provide a better air-tight seal.

The fruits and vegetables are placed within the storage containers (6), FIG. 12, which are located within the outer casing (1). Adhesive backed neoprene rubber strips (10) are positioned on the inside lip of the overhang platform (5), as well as the back inside wall of the outer casing. This gasketing allows for an air tight fit of the storage containers (6), which in turn allows the Gas Permeable Non-Woven Fabric based Film to control the atmosphere underneath the overhang platform (5) as well as within the storage containers (6). The atmosphere within the storage containers (6) and the atmosphere underneath the overhang platform (5) are homogenous due to the entrances to the storage boxes (13,16,17,19). These entrances allow the air within the storage boxes (6) to freely flow out of the storage boxes (6) and up through the Gas Permeable Non-Woven Fabric based Film which is covering the hole cut into the overhang platform (5).

The atmosphere in the storage containers (6) is further controlled by moving the slide (3) within the slide housing (2) via the slide knob (4) over the hole cut into the overhang platform. The user slides the slide (3) to the desired numbered notch which is located on the side of the slide housing (2). Each numbered notch correlates to how affective you are allowing the Gas Permeable Non-Woven Fabric based Film to modify the atmosphere within the storage containers (6). The notched number the user would slide the leading edge of the slide (2) to depends on the quantity and type of FF&V stored within the storage containers. Adjustment of the slide (2) is necessary for any change in quantity or type of FF&V stored within the storage containers (6).

When a storage container lid is removed, its atmosphere is sealed off from the other storage containers and the atmosphere underneath the overhang platform. This is accomplished by allowing the gates (12,14,20) which are located in voids (11,15,18) between the walls of the storage containers (6) to fall when the lids are removed, sealing the entrances to the storage boxes (13,16,17,19). The gates (12,14,20) of the storage boxes (6) are conversely drawn up when the lids are on, exposing the entrances (13,16,17,19) to the storage boxes (6), which allows the atmosphere within the storage containers to once again be controlled by the Gas Permeable Non-Woven Fabric based Film. The storage containers' gates (12, 14,20) are drawn up when the lids are on via the adhesive backed magnetic strips (21,24,27) which are located on the storage containers' lids. These lids are able to draw the storage containers' gates up due to the fact that the gates are constructed out of 410 stainless steel, which is magnetic.

The storage container lids also provide an airtight seal when on their corresponding storage containers via adhesive backed neoprene rubber strip (22,25,28). Each storage container lid can be removed and re-installed via its corresponding lid handle (23,26,29).

The storage boxes (6) and slide (3) can be accessed within the outer casing (1) by pushing the outer casing lid (8) upwards via the outer casing lid handle (9). The outer casing lid (8) is held in place and allowed to open via the hinge (7).

Depicted below and in accordance with the drawings are example of produce storage and more particularly to such a packaging system as is suitable for extending the shelf life of fresh fruits and vegetables (both whole and fresh cut), and vase life of flowers. The configurations below include formation of the gas permeable non-woven fabric film, or membrane, for providing particular permeability according to a predetermined transfer rate and packaging configurations employing the gas permeable non-woven fabric for storing and transporting produce products stored therein.

The gas permeable non-woven fabric based film (film) is employed in packaging for extending the shelf life of various fresh fruits and vegetables and vase life of fresh cut flowers by changing the atmosphere in which these living products are stored and respires. The high oxygen and carbon dioxide permeability of the film establishes an ideal atmosphere for the specific perishable item, and therefore extends its shelf life.

The establishment of lower oxygen and carbon dioxide atmospheres inside packages using the film also leads to reduction in the respiration rate of the perishable items. The reduction in the respiration rate prevents loss of moisture, production of metabolic heat, and yellowing, browning, reduction in production levels of ethylene. Therefore, the created atmosphere is able to extend shelf life, maintain high quality and preserve nutrients of fresh produce items by naturally regulating respiration of said produce/flower.

Formation of the Gas Permeable Non-Woven Fabric based Film fabrication process includes creation of these films. The components for the film include polydimethyl siloxane (PDMS) base (This polydimethyl siloxane either consists of >60.0% Dimethyl siloxane, dimethylvinyl-terminated, 30.0-60.0% Dimethylvinylated and trimethylated silica, and 1.0-5.0% Tetra(trimethylsiloxy) silane, or >60.0% Dimethyl siloxane, dimethylvinyl-terminated and 30.0-60.0% Dimethylvinylated and trimethylated silica.), and curing agent mixed in the ratio 10:1, non-woven fabric (50% polyester, 50% Rayon). A mylar Rod (#3, which creates a film thickness of 0.27 MIL) was also used.

b. Mix the PDMS base and curing agent in a 10:1 ratio measured by weight c. De-gas the polymer in a desiccator for approximately 30 minutes. This removes any air bubbles resulting from the mixing process.

d. Pour this mixture on a non woven fabric, and roll the Mylar Rod #3 to form a uniform spread. Mylar rod #3 deposits a thickness of 0.27 MIL on the fabric.

e. Preheat oven for 20 minutes at 170° F. (76.6° C.).

f. Cure the PDMS-coated fabric at 170° F. (76.6° C.) for 20 minutes to promote cross-linking.

Process to design packages using the Gas Permeable Non-Woven Fabric based film. The respiration rates, ideal atmospheres, and ethylene sensitivities for various perishable items, including fresh fruits and vegetables and fresh cut flowers have been documented by University of California, Davis. The information available was utilized in designing these packages.

a. Identify the perishable item that is to have a shelf life extension. Items identified and tested have included, broccoli, cilantro, bananas, whole corn, lettuce, tomatoes, red seedless grapes, mushrooms, strawberries and cut flowers (roses, orchids, gerbera and tulips).

b. For example, in the case of bananas, the respiration rates, ideal atmospheres and ideal storage temperatures were identified. The Oxygen transmission Rates (OTR) and Carbon Dioxide transmission Rates (COTR) for the Gas Permeable Non-Woven Fabric based film have already been tested by an independent test agency, Mocon Inc., of Minneapolis, Minn. The OTR and COTR values define the permeability for particular agricultural items, for example by measuring[[e]] the weight of the produce, such as bananas. In a particular configuration, the OTR and COTR for these films at 13.3° C. (an ideal temperature for bananas) tested at 111,735 and 699,000 cc/100in^2/day/atm respectively. Using the weights, respiration rates, ideal atmospheres, COTR and OTR of these films, the surface area needed for these films can be calculated. Take the produce bag, can be low density polyethylene bag (LDPE), high density polyethylene bag (HDPE), or any other non-porous material based, used to store bananas, and cut a hole in the bag equivalent to the surface area needed for the film.

c. Using a good adhesive tape (such as electrical insulating tape), attach the Gas Permeable Non-Woven Fabric based film at the position where the produce bag has a hole.

d. Place the produce, banana inside the bag.

e. Using a regular elastic band close the opening of the produce bag.

The produce bag with the Gas Permeable Non-Woven Fabric based Films will naturally attain the ideal atmospheres needed for bananas, and therefore will extend its shelf life. Testing results have successfully been able to extend the life of bananas to 20+days.

As the produce or other agricultural items respire, they consume oxygen and give off carbon dioxide, and an the equilibrium gas concentration is established in the package. This process is a function of the gas permeable film permeability and carbon dioxide to oxygen selectivity ratio. Thus, the created atmosphere (typically 2-20% oxygen and 5-15% carbon dioxide) is able to extend shelf life, maintain high quality and preserve the nutrients by naturally regulating respiration of the produce and/or agricultural items. Lower oxygen levels substantially around 2% reduce the metabolic activity of the perishable item (produce) and elevated carbon dioxide levels prevent rotting and fungal growth. Lower levels of oxygen also reduce the ethylene production of the perishable items. Predominantly perishable items with high sensitivity towards ethylene benefit from avoidance of elevated ethylene levels. Ethylene promotes ripening of bananas, and therefore lower ethylene levels tend to extend the shelf life of bananas. By changing the surface area and the thickness of the gas permeable film, the permabilities to oxygen and carbon dioxide can be controlled, and therefore longer shelf life agricultural items such as fruits and vegetables is promoted.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

What is claimed is:

1. A shelf life extending container including a gas permeable film, the gas permeable film consisting of:

a. a non-woven fabric substrate, the substrate adapted for transmission of gases;

b. a polymer coating on the non-woven fabric substrate, the polymer coating having a thickness between 0.18 MIL-2.0 MIL, the polymer coating having a predetermined thickness dependent upon a type of a produce item, the produce item responsive to a created atmosphere resulting from the polymer coating, and the weight of the produce items;

i. the polymer coating having an oxygen permeability of at least 55,000 cc/100 $in^2$/day/atm, with a maximum permeability of 611,111 cc/mil/100 $in^2$/day/atm at 13° C.; and ii. the polymer coating having a carbon dioxide permeability of at least 350,000 cc/100 $in^2$/day/atm, with a maximum permeability of 3,888,889 cc/100 $in^2$/day/atm at 13° C.;

the shelf life extending container defining a created atmosphere there within for extending the shelf life of multiple agricultural items.

2. The shelf life extending container according to claim 1, further comprising multiple small containers adapted to receive multiple agricultural items.

3. The shelf life extending container according to claim 1, further comprising one container adapted to receive agricultural items including whole and cut fruits and vegetables and cut flowers.

4. The shelf life extending container according to claim 1, wherein the container is configured to extend the shelf life of whole fruits, vegetables, cut fruits and cut vegetables.

5. The shelf life extending container according to claim 3, further comprising a slide mechanism and a moveable slide.

* * * * *